US006261148B1

(12) United States Patent
Robinson

(10) Patent No.: US 6,261,148 B1
(45) Date of Patent: Jul. 17, 2001

(54) TWISTING ANIMATED FIGURE

(76) Inventor: Juanita Robinson, 3369 Faith Rd., LaGrange, NC (US) 28551

( * ) Notice: Subject to any disclaimer, the term of this patent is extended or adjusted under 35 U.S.C. 154(b) by 0 days.

(21) Appl. No.: 09/354,647

(22) Filed: Jul. 16, 1999

(51) Int. Cl.[7] ..... A63H 13/00
(52) U.S. Cl. ..... 446/353; 446/298
(58) Field of Search ..... 446/268, 297, 446/298, 330, 331, 352, 353

(56) References Cited

U.S. PATENT DOCUMENTS

| | | | | |
|---|---|---|---|---|
| 2,504,652 | | 4/1950 | Cohn | 46/136 |
| 2,637,936 | * | 5/1953 | Dale et al. | 40/411 |
| 2,958,144 | | 11/1960 | Stranges | 40/106.3 |
| 3,648,405 | | 3/1972 | Tepper | 46/120 |
| 4,545,775 | * | 10/1985 | Kim | 446/299 |
| 4,723,932 | | 2/1988 | Kelley | 46/330 |
| 4,875,886 | * | 10/1989 | Sung | 446/298 |
| 4,968,280 | | 11/1990 | Kelley | 46/330 |
| 5,413,517 | | 5/1995 | Kamijima | 46/354 |
| 5,495,151 | | 2/1996 | Lu | 318/4 |
| 5,888,116 | | 3/1999 | Espada | 446/253 |

* cited by examiner

*Primary Examiner*—John A. Ricci
(74) *Attorney, Agent, or Firm*—JoAnne M. Denison; Denison & Assoc, PC

(57) ABSTRACT

The present invention consists of twist dancing doll which is provided with an interior housing containing a reciprocating motor which moves a drive shaft through a short arc back and forth, a hip form which communicates with this drive shaft, a gear mounted on the end of this drive shaft, a reverse gear communicating effectively with the gear to produce an opposite motion, a reverse drive shaft, a shoulder form which communicates with the reverse drive shaft to produce a twist motion in the shoulder portion which is directly opposite that of the hip portion, so that when the animated twist doll is in operation the doll appears to dance the twist. Of course, an electronic tune generating device is also present for additional enjoyment of the user.

5 Claims, 1 Drawing Sheet

TWISTING ANIMATED FIGURE

FIELD OF THE INVENTION

The present invention relates to the field of animated doll designs, and in particular those which have a doll or figure which is mechanically animated and has music that the figure dances to.

BACKGROUND OF THE INVENTION

In the past, there have been a number of devices relating to the design of animated dolls or figures which may or may not have a music source which the figure appears to dance to or move with.

In reviewing the prior art, there is seen a hula hoop doll disclosed in U.S. Pat. No. 2,958,144 issued Nov. 1, 1960 which is provided with two leg members having an interior spring which is attached to a hip element. The hip element gyrates on an eccentric by means of an offset drive stem which communicates therewith so that the doll appears to effectively play with her hula hoop accessory. However, this device is not provided with any movement in the shoulder portion, nor is it provided with any means for playing a tune for additional amusement of the user.

For example, U.S. Pat. No. 2,637,936 issued May 12, 1953 discloses the use of an animated figure wherein an animated doll is provided with a drive shaft which runs through a hollow interior portion of her leg wherein it effectively communicates with a linkage to produce a gyrating, tilting motion in the hips of the mannequin. The motion includes a seesaw effect in the hips. A yoke located in the shoulder is simultaneously pivoted on its axis to rotate back and forth through a short arc which allows the shoulders to seesaw up and down as well. However, a true twisting effect is not achieved. The entire mannequin also turns on its axis on a turntable provided therewith.

Further, U.S. Pat. No. 2,504,652 issued Apr. 18, 1950 discloses the use of a dancing doll on a platform which bounces up and down through a spring winded mechanism to produce a wiggly, jiggly effect though use of an interior eccentric weight to produce a rocking motion of the doll upon its base.

Two other interesting disclosures, U.S. Pat. Nos. 3,648,405 and 4,723,932 disclose the use of interior gearing within a doll so that when the body is tilted by the user, the arms will swing back and forth.

Thus, nowhere in the prior is seen a mechanized, tune playing, animated doll having a true twisting motion where the hips move back and forth through a short arc exactly opposite that of the movement of a shoulder portion of the doll.

SUMMARY OF THE INVENTION

The present invention consists of an improved doll design having an electronic speaker element which is positioned in the chest, stomach, hips or platform of a mechanized figure which provides a twist tune wherein the doll will twist its chest in one direction through a short arc, while the hip portion twists in the opposite direction through a short arc.

The twisting effect is achieved by providing an electric, oscillating motor in either the shoulder, hip, stomach or platform of the doll and using suitable gearing to reverse the direction of movement in the appropriate corresponding area of the doll. The doll is intended to be built on a wire platform, and preferably has shoulder and hip portion elements to which loose clothing may be attached.

OBJECTS OF THE INVENTION

Thus, it is one primary object of the instant invention to provide an animated doll with hips that twist through a small arc in one direction, while the shoulder portion of the doll twists simultaneously in the opposite direction.

It is an additional primary object of the instant invention to provide a doll with a twisting effect in both the hip and shoulder portions further having a speaker and an electronic tune generator which can produce an audible twist tune while the doll is in motion.

It is further a primary object of the instant invention to provide direct simple gearing from a motor which is provided with reciprocating gearing so as to produce a simple back and forth motion through a small arc.

It is further a primary object of the present invention to provide a mechanized doll with a twisting mechanism with a complete interior housing which contains a drop in gearing mechanism which is simple and inexpensive in design, yet sturdy and durable.

It is further a primary object of the present invention to provide a mechanized doll with a twisting mechanism where in the gearing mechanism has a minimum of elements to produce maximum twisting motion, and it further allows it to be easily removed to be reset.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
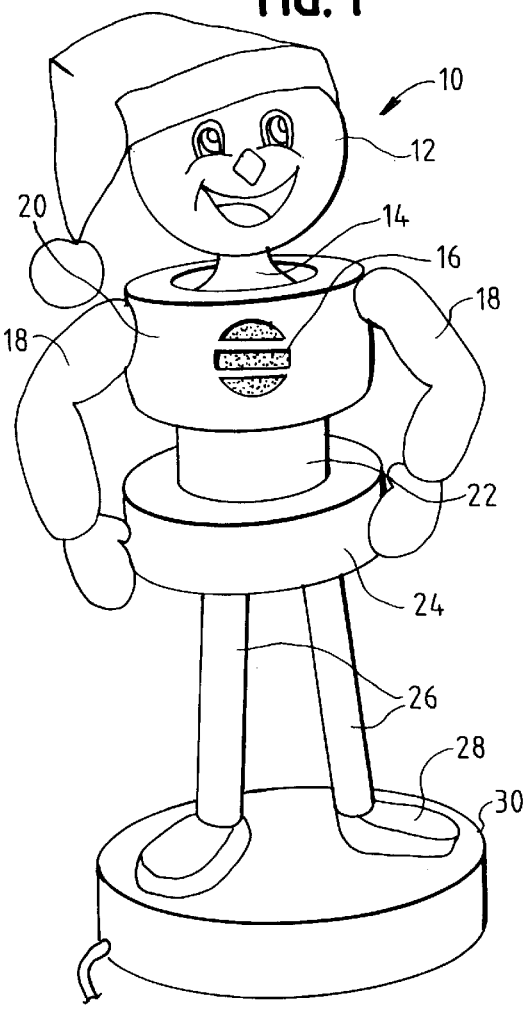
FIG. 1 is a front perspective of the present invention showing the animated figure with its outer clothing removed.

Shown now in FIG. 1 is the present invention, twist dancing doll 10 in its unclothed state which shows twist dancing doll 10 firmly attached to platform 30 by means of adhesive or fastening elements such as screws or bolts, commonly known in the art. The head of the doll, 12 is mounted on neck 14 which may from an integral part of cylindrical motor housing 22. The cylindrical motor housing 22 is preferably made from a rigid plastic as it supports twist dancing doll 10 and provides important structural integrity to the design. A shoulder form 20 with arms 18 attached thereto is provided which can twist independently back and forth through a small arc when the twist dancing doll 10 is turned on. Of course an on/off switch and a volume control may be conveniently located within platform 30 to adjust the volume of an electronic tune generator and its duration of play. An electronic tune generator plays through speaker 16 located in shoulder form 20. Hollow leg elements 26 are capable of hiding the wiring for the electronic controls such as the on/off switch and the volume control. Hip form 24 is also provided which is capable of twisting through a short arc when the unit is switched on, but in the exact opposite direction of shoulder form 20.

Hollow leg elements 26 are further provided which firmly attach to the bottom of cylindrical housing 22. Feet 28 are provided to stabilize and provide a mechanism to attach the doll to the base of the unit, platform 30.

Figure 2:
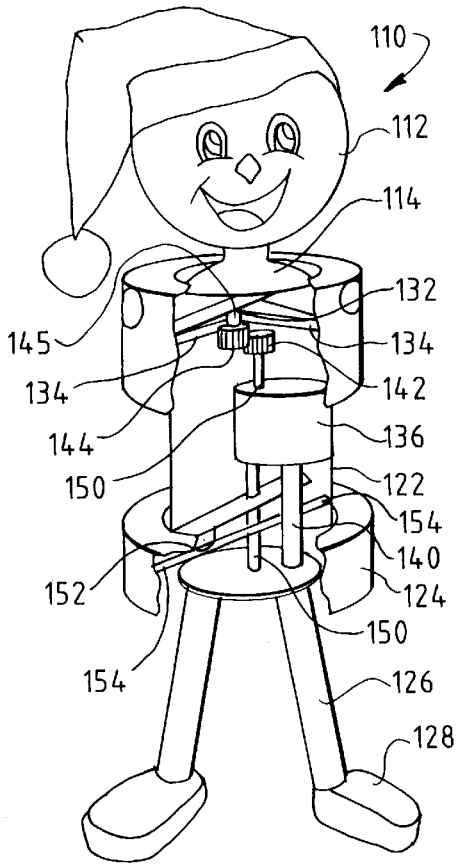
FIG. 2 is a front partial break away perspective of the present invention without clothes or arms showing the interior view of the doll and the motor and gearing associated therewith to producing a twisting motion.
Figure 3:
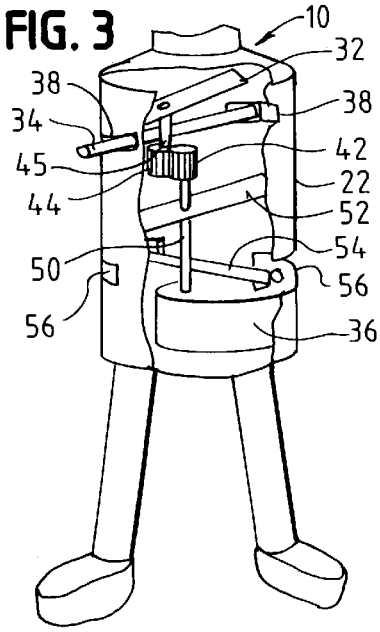
FIG. 3 is a front partial break away perspective of the present invention showing the details of the interior housing and the motor mounted to the leg platform of the present invention.

FIG. 2 shows in greater detail the inner working mechanisms of twist dancing doll 110 in a slightly different version of the doll shown in FIG. 1. In this cut away view of twisting doll 1 10 is shown the interior of cylindrical housing 122 and the mechanism by which the gears and motor drive is supported by to produce a true twisting motion in both the shoulder portion and hip portion of the doll. Twist dancing doll 110 differs from the twist dancing doll 10 in that its motor 136 is located in the center of cylindrical housing 22, whereas the interior of the twist doll 10 is shown in FIG. 3 where the hip form 24 and shoulder form 20 are shown as off of the twist dancing doll, and motor 36 is shown at the bottom of cylindrical housing 22. Leg supports 126 and feet 128 are used to support twist dancing doll 110. FIG. 2 shows reciprocating motor 136 which produces a twisting motion through approximately a sixty degree arc, although other ranges of motion may be desired for a greater or lesser twisting effect. Reciprocating 136 motor is in turn attached to drive shaft 150 which extends both above and below the reciprocating motor 136. The reciprocating motor 136 is supported by motor support element 140 which is affixed to the floor of cylindrical housing 122. The lower length of drive shaft 150 extends to the floor of cylindrical housing 122 though the motor housing of reciprocating motor 136. A lower yoke 152 spans the distance between sidewalls of the cylindrical housing 122 for proper stability. Two lower strut arms 154 extend from opposing sides of drive shaft 150 in its lower portion through a pair of slots located in the lower end of cylindrical housing 122 and communicate effectively with hip form 124 to move it back and forth through a short arc.

From above, in the shoulder portion of the doll, drive shaft 150 extends upwardly terminating in drive gear 142 which communicates with reverse gear 144 which is mounted on reverse drive shaft 145. Also mounted on reverse drive shaft are 145 a pair of opposing struts 134 which extend through a corresponding pair of slots in cylindrical housing 122 to produce an opposite twisting motion though a short arc of the shoulder portion only of the doll. In such a manner, twist dancing doll 110 appears to do the twist for amusement and entertainment of the individual.

At the top central portion of cylindrical housing 122 is positioned neck portion 114 to which is secured the head of the doll 112 which remains stationary during this operation. Of course, reverse drive shaft 145 could be made simply to extend through the top wall of cylindrical housing 122 and the head of the doll 112 could be mounted thereto to provide a corresponding twist motion to the head of the doll. If it is desired that the head 112 move more slowly than the shoulder portion of the doll, or through a reduced arc, appropriate reduction gearing could be provided as it is well known in the art to provide additional gears with extra teeth in the ratio desired to produce the correct motion. An upper yoke 132 is also shown which provides additional stability and durability to the gearing shown in the figure.

FIG. 3 shows the first version of the twist dancing doll 10 showing greater details of how a reciprocating motor 36 may be attached to the floor of cylindrical housing 22, with a drive shaft 50 extending upwards though a stabilizing lower yoke 52, with a pair of opposing lower strut arms 54 extending through lower slots 56 to effectively communicate with the interior portion of hip form 24, which has been removed in this Figure to better show the internal mechanisms of the present invention. Drive shaft 50 terminates in gear 42 which in turn communicates with reverse gear 44 to produce a twisting motion in the opposite direction. This reverse gear 44 is mounted on reverse drive shaft 45 which has been provided with a pair of upper strut arms 34 extending through upper slots 38 which communicate effectively with the interior of shoulder form 20 such that it will twist back and forth through a short arc. An additional stabilizing element, upper yoke 32 may be provided so that the reverse drive shaft 45 is held firmly in place to provide and enhance proper gear meshing.

Of course, reverse drive shaft 45 may be made to extend completely upwardly through the top center of cylindrical housing so that head 12 may be attached thereto so that it can also move from side to side with the shoulder portion of the animated twist dancing doll 10.

The present invention can be economically made from simple metal and plastic components. The shafts are preferably made from common steel, while the entire housing, hip and shoulder forms, struts and yokes may be made from a rigid plastic, as may be made the feet, hollow legs, head and arms.

Figure 4:
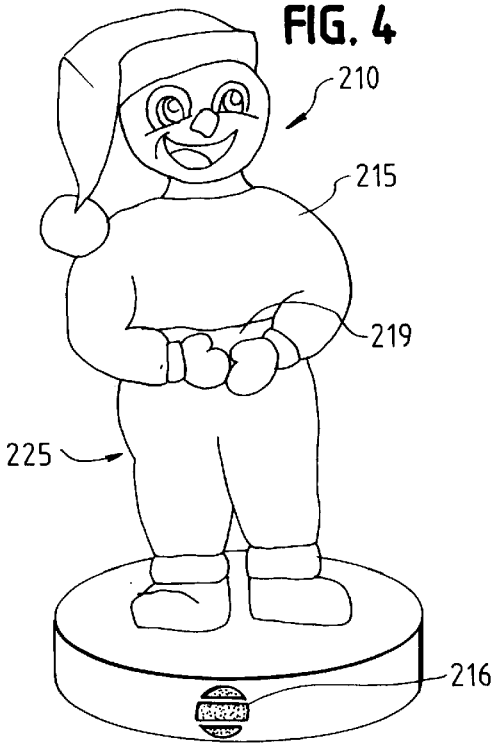
FIG. 4 shows the present invention in its full dressed and operational form showing how the twisting motion in the shoulder portion is directly opposite that of the hip portion.

Finally, FIG. 4 shows a preferred embodiment of twist dancing doll 210 in its proper dancing form with the shoulders 215 moving in one direction while the hips 225 move in directly the opposite direction, with the waist 219 of the twist dancing doll 210 perfectly stable for amusement of the user. In this preferred embodiment, speaker 216 is shown in the base of the doll, although it has been noted that a small electronic speaker may be placed any where in on the device, as in the hip form, the shoulder form, anywhere within the cylindrical housing, and even in the back of the twist dancing doll's head.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A twist dancing doll having a head and body portion wherein the body portion is provided with a hip form, a shoulder form, and a housing wherein the housing further contains a reciprocating motor, a forward drive shaft communicating with the reciprocating motor, and struts extending from the forward drive shaft which struts communicate with the hip form to make it swing back and forth in a short arc, gearing means and a reverse drive shaft extending therefrom which reverses the direction of the forward drive shaft with the reverse drive shaft also having struts extending therefrom which communicate with the shoulder form to make it swing back and forth in a short arc, such that the twist dancing doll appears to do the twist.

2. The twist dancing doll according to claim 1 which is further provided with a speaker for playing a pre-recorded tune.

3. The twist dancing doll of claim 2 wherein the speaker for playing a pre-recorded tune is secured to the shoulder form of the doll.

4. The twist dancing doll of claim 3 wherein the speaker for playing a pre-recorded tune is secured to the housing.

5. The twist dancing doll of claim 1 wherein the reverse drive shaft and the drive shaft are further provided with yokes for stability and proper meshing of the gearing means to which they communicate with.

* * * * *